US010580303B2

(12) United States Patent
Morotomi et al.

(10) Patent No.: US 10,580,303 B2
(45) Date of Patent: Mar. 3, 2020

(54) COLLISION AVOIDANCE DEVICE

(71) Applicant: TOYOTA JIDOSHA KABUSHIKI KAISHA, Toyota-shi, Aichi-ken (JP)

(72) Inventors: Kohei Morotomi, Shizuoka-ken (JP); Masayuki Katoh, Gotemba (JP); Noriyuki Tsuruoka, Susono (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 18 days.

(21) Appl. No.: 15/918,637

(22) Filed: Mar. 12, 2018

(65) Prior Publication Data

US 2018/0268702 A1 Sep. 20, 2018

(30) Foreign Application Priority Data

Mar. 16, 2017 (JP) ..... 2017-051276

(51) Int. Cl.
*G08G 1/16* (2006.01)

(52) U.S. Cl.
CPC ..... *G08G 1/166* (2013.01); *G08G 1/165* (2013.01)

(58) Field of Classification Search
CPC ..... G08G 1/166
See application file for complete search history.

(56) References Cited

U.S. PATENT DOCUMENTS 5,002,145 A * 3/1991 Wakaumi ..... B62D 1/28 180/168
5,939,976 A * 8/1999 Sasaki ..... G08G 1/164 340/435
6,114,951 A * 9/2000 Kinoshita ..... B60Q 9/008 340/435
9,129,519 B2 * 9/2015 Aoude ..... G08G 1/00
9,751,506 B2 * 9/2017 Mudalige ..... G08G 1/166
2007/0280503 A1 * 12/2007 Kubota ..... B60Q 1/50 382/103
2007/0282532 A1 * 12/2007 Yamamoto ..... B60R 21/0134 701/301
2012/0016581 A1 * 1/2012 Mochizuki ..... G08G 1/161 701/301
2014/0316668 A1 * 10/2014 Akiyama ..... B60W 10/184 701/70

(Continued)

FOREIGN PATENT DOCUMENTS

JP 05-024524 A 2/1993
JP 2004-280453 A 10/2004

*Primary Examiner* — Babar Sarwar
(74) *Attorney, Agent, or Firm* — Sughrue Mion, PLLC

(57) ABSTRACT

A collision avoidance device includes an electronic control unit configured to: calculate a deflection angle that is a change angle of a direction of a host vehicle turning in a direction of a blinker in a turn-on state based on a direction of the host vehicle when the host vehicle switches the blinker into the turn-on state; and execute a collision avoidance control for avoiding a collision between the host vehicle and an obstacle in a case where the electronic control unit determines that there is a collision possibility between the host vehicle and the obstacle based on a path of the host vehicle on an intersection and a position of the obstacle, wherein the electronic control unit is configured not to execute the collision avoidance control when the deflection angle is equal to or greater than a deflection angle threshold.

8 Claims, 7 Drawing Sheets

(56) References Cited

U.S. PATENT DOCUMENTS

| | | | | |
|---|---|---|---|---|
| 2015/0057891 | A1* | 2/2015 | Mudalige | B60W 10/00 701/42 |
| 2016/0101731 | A1* | 4/2016 | Matsuoka | G08G 1/166 340/435 |
| 2016/0193999 | A1* | 7/2016 | Sasabuchi | B60T 7/22 701/301 |
| 2016/0335892 | A1* | 11/2016 | Okada | B60T 7/22 |
| 2016/0368492 | A1* | 12/2016 | Al-Stouhi | B60W 30/18154 |
| 2017/0084177 | A1* | 3/2017 | Matsuoka | B60W 30/09 |
| 2017/0113683 | A1* | 4/2017 | Mudalige | B60W 30/08 |
| 2017/0205506 | A1* | 7/2017 | Voorheis | G01S 13/867 |
| 2017/0259734 | A1* | 9/2017 | Imaishi | B60Q 1/444 |
| 2017/0278397 | A1* | 9/2017 | Kouyama | G08G 1/096791 |
| 2017/0336800 | A1* | 11/2017 | Chou | G05D 1/0274 |
| 2017/0352274 | A1* | 12/2017 | Kodama | B60Q 1/38 |
| 2018/0001952 | A1* | 1/2018 | Rajamani | B62J 27/00 |
| 2018/0029533 | A1* | 2/2018 | Goudy | B60Q 9/008 |
| 2018/0141588 | A1* | 5/2018 | Shimizu | B62D 6/00 |

* cited by examiner

COLLISION AVOIDANCE DEVICE

INCORPORATION BY REFERENCE

The disclosure of Japanese Patent Application No. 2017-051276 filed on Mar. 16, 2017 including the specification, drawings and abstract is incorporated herein by reference in its entirety.

BACKGROUND

1. Technical Field

The present disclosure relates to a collision avoidance device.

2. Description of Related Art

In the related art, as a technical literature relating to collision avoidance at the time of a right turn of a host vehicle, Japanese Unexamined Patent Application Publication No. 2004-280453 (JP 2004-280453 A) is known. JP 2004-280453 A discloses a right turn safety confirmation system that sets a predicted right turn trajectory (a predicted trajectory at the time of the right turn) of the host vehicle in front of the right side of the host vehicle, and in a case where an oncoming vehicle reaches the predicted right turn trajectory within a needed right turn time set in advance, determines that there is a collision possibility between the oncoming vehicle and the host vehicle. In the right turn safety confirmation system, in a case where determination is made that there is a collision possibility between the oncoming vehicle and the host vehicle, a warning is issued to a driver for collision avoidance.

SUMMARY

However, since the time needed for a right turn of the host vehicle changes with a vehicle speed of the host vehicle, or an intersection angle or a traffic status of an intersection road, there is room for improvement on determination of a collision possibility using the needed right turn time set in advance like the system of the related art described above. For example, in a case where the host vehicle performs a right turn at a vehicle speed higher than usual, the host vehicle substantially completes the right turn before the needed right turn time ends, and moves toward a road to be a right turn destination. In this case, when the predicted right turn trajectory of the host vehicle set in front of the right side of the host vehicle enters an oncoming lane over a center line of the road to be a right turn destination, determination on a collision possibility between a vehicle that travels on the oncoming lane to be a right turn destination and the host vehicle is performed, and there is a possibility that unneeded collision avoidance control (warning or the like) is executed.

The present disclosure provides a collision avoidance device capable of suppressing execution of unneeded collision avoidance control.

A first aspect of the present disclosure is a collision avoidance device including an electronic control unit configured to: calculate a deflection angle that is a change angle of a direction of a host vehicle turning in a direction of a blinker in a turn-on state based on a direction of the host vehicle when the host vehicle switches the blinker into the turn-on state; and execute a collision avoidance control for avoiding a collision between the host vehicle and an obstacle in a case where the electronic control unit determines that there is a collision possibility between the host vehicle and the obstacle based on a path of the host vehicle on an intersection and a position of the obstacle, wherein the electronic control unit is configured not to execute the collision avoidance control when the deflection angle is equal to or greater than a deflection angle threshold.

With the collision avoidance device according to the first aspect of the disclosure, when the deflection angle of the host vehicle based on the direction of the host vehicle when the host vehicle turning right or left switches the blinker into the turn-on state is equal to or greater than the deflection angle threshold, the collision avoidance control is not executed. Accordingly, with the collision avoidance device, the time when the deflection angle of the host vehicle is equal to or greater than the deflection angle threshold is immediately before a right or left turn of the host vehicle is completed, and there is a high possibility that determination is erroneously made on a collision possibility between an obstacle on the oncoming lane of the road to be a right or left turn destination and the host vehicle. For this reason, it is possible to suppress execution of unneeded collision avoidance control by not executing the collision avoidance control.

In the collision avoidance device according to the first aspect of the disclosure, the electronic control unit may be configured to: recognize an intersection angle between a first lane on which the host vehicle is traveling and a second lane that the host vehicle enters; and set the deflection angle threshold based on the intersection angle.

With the collision avoidance device according to the first aspect of the disclosure, a turning angle (deflection angle) needed for completion of a right or left turn of the host vehicle changes with the intersection angle between the first lane on which the host vehicle is traveling and the second lane that the host vehicle enters. For this reason, the deflection angle threshold changes based on the intersection angle, whereby it is possible to appropriately suppress the execution of the collision avoidance control.

A second aspect of the present disclosure is a collision avoidance device comprising electronic control unit configured to: calculate a deflection angle that is a change angle of a direction of a host vehicle turning in a direction of a blinker in a turn-on state based on a direction of the host vehicle at a time when the host vehicle switches the blinker into the turn-on state; and output a signal for executing a collision avoidance control when the deflection angle is equal to or less than a deflection angle threshold and the electronic control unit determines that there is a collision possibility between a host vehicle and an obstacle based on a path of the host vehicle on an intersection and a position of the obstacle.

The collision avoidance device according to the second aspect of the disclosure may further include an intersection angle recognition unit configured to recognize an intersection angle between a first lane on which the host vehicle is traveling and a second lane that intersects the first lane to form an intersection and that the host vehicle enters. The deflection angle calculation unit may set the deflection angle threshold based on the intersection angle.

The collision avoidance device according to the second aspect of the disclosure may further include an actuator configured to control a behavior of the vehicle, wherein the actuator may be configured to be driven based on a signal from the electronic control unit.

As described above, according to the aspects of the disclosure, it is possible to suppress execution of unneeded collision avoidance control.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
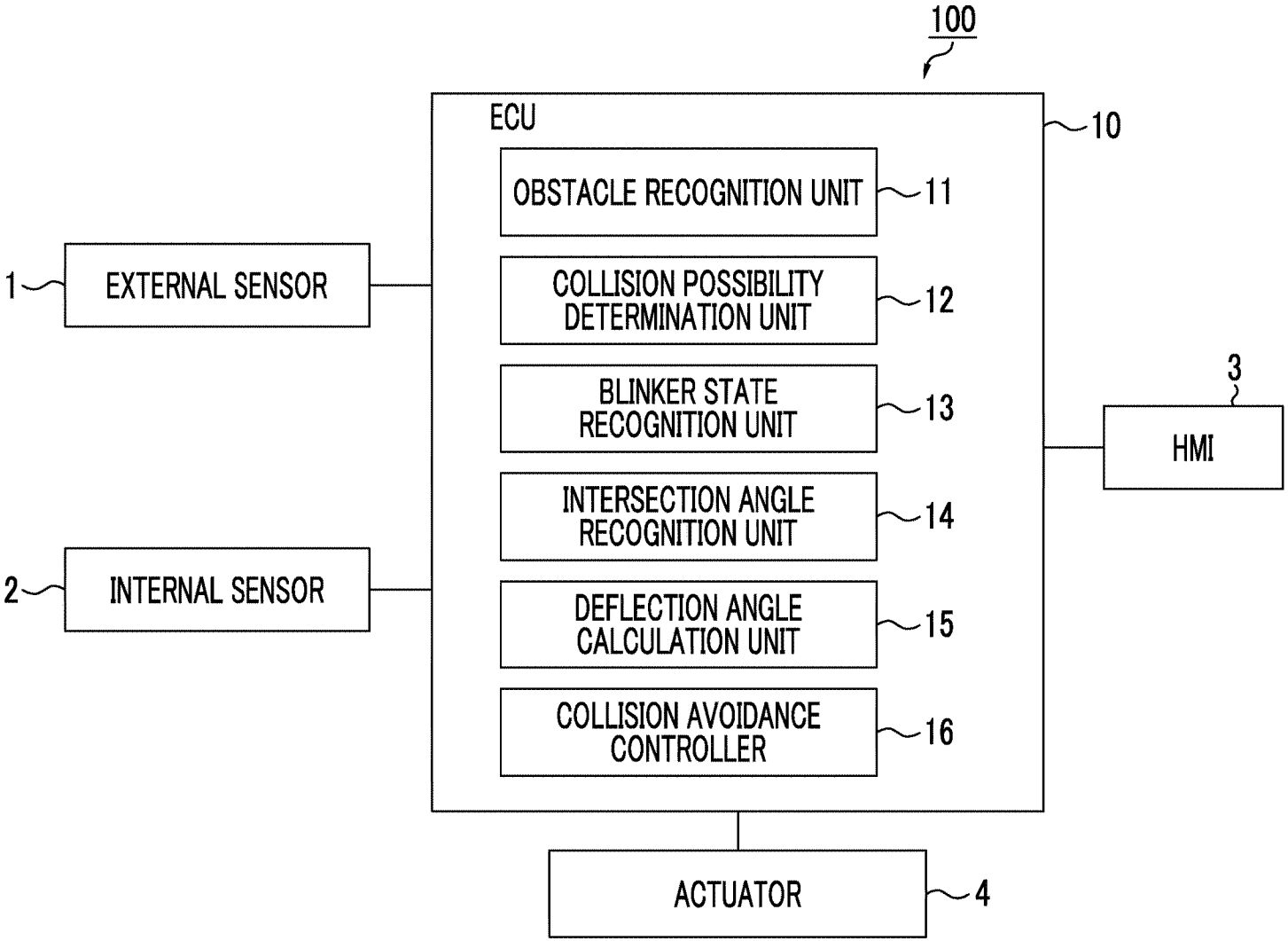
FIG. 1 is a block diagram showing a collision avoidance device according to an embodiment.

Hereinafter, an embodiment of the disclosure will be described referring to the drawings.

FIG. 1 is a block diagram showing a collision avoidance device according to the embodiment. A collision avoidance device 100 shown in FIG. 1 is mounted in a vehicle (host vehicle), such as a passenger vehicle, and determines a collision possibility between the host vehicle and an obstacle. The collision avoidance device 100 executes collision avoidance control for avoiding a collision between the host vehicle and the obstacle in a case where determination is made that there is a collision possibility between the host vehicle and the obstacle. The collision avoidance control in the embodiment is, as an example, control (right-turn oncoming vehicle pre-crash safety system [PCS] control) for avoiding a collision between an oncoming vehicle and the host vehicle at the time of the right turn of the host vehicle in a left-hand traffic country or zone.

Configuration of Collision Avoidance Device

As shown in FIG. 1, the collision avoidance device 100 according to the embodiment includes an electronic control unit [ECU] 10 that integrally manages the device. The ECU 10 is an electronic control unit having a central processing unit [CPU], a read only memory [ROM], a random access memory [RAM], a controller area network [CAN] communication circuit, and the like. In the ECU 10, for example, various functions are realized by loading a program stored in the ROM on the RAM and executing the program loaded on the RAM on the CPU. The ECU 10 may be constituted of a plurality of electronic units.

The ECU 10 is connected to an external sensor 1, an internal sensor 2, a human machine interface [HMI] 3, and an actuator 4.

The external sensor 1 is detection equipment that detects conditions around the vehicle. The external sensor 1 includes at least one of a camera and a radar sensor.

The camera is imaging equipment that images external conditions of the vehicle. The camera is provided on a rear side of a windshield of the vehicle. The camera transmits imaging information relating to the external conditions of the vehicle to the ECU 10. The camera may be a monocular camera or a stereo camera. The stereo camera has two imaging units disposed so as to reproduce binocular parallax. Imaging information of the stereo camera includes information in a depth direction.

The radar sensor is detection equipment that detects an obstacle around the vehicle using electric waves (for example, millimeter waves) or light. Examples of the radar sensor include a millimeter-wave radar or light detection and ranging [LIDAR]. The radar sensor transmits electric waves or light around the vehicle and receives electric waves or light reflected from obstacles to detect obstacles. The radar sensor transmits detected obstacle information to the ECU 10. Examples of the obstacles include movable obstacles, such as pedestrians, bicycles, and other vehicles, in addition to fixed obstacles, such as guardrails and buildings.

The internal sensor 2 is detection equipment that detects a traveling state and a vehicle state of the host vehicle. The internal sensor 2 includes a vehicle speed sensor, an acceleration sensor, and a yaw rate sensor. The vehicle speed sensor is a detector that detects a speed of the host vehicle. As the vehicle speed sensor, for example, a wheel speed sensor that is provided in a wheel of the host vehicle, a drive shaft configured to rotate integrally with the wheel, or the like, and detects a rotation speed of the wheel is used. The vehicle speed sensor transmits detected vehicle speed information (wheel speed information) to the ECU 10.

The acceleration sensor is a detector that detects an acceleration of the host vehicle. The acceleration sensor includes, for example, a longitudinal acceleration sensor that detects a longitudinal acceleration of the host vehicle, and a lateral acceleration sensor that detects a lateral acceleration of the host vehicle. For example, the acceleration sensor transmits acceleration information of the host vehicle to the ECU 10. The yaw rate sensor is a detector that detects a yaw rate (rotational angular velocity) of the center of gravity of the host vehicle around a vertical axis. As the yaw rate sensor, for example, a gyro sensor can be used. The yaw rate sensor transmits detected yaw rate information of the host vehicle to the ECU 10.

The internal sensor 2 detects a turn-on state of a blinker of the host vehicle as a vehicle condition. That is, the internal sensor 2 includes a blinker sensor. For example, the blinker sensor is provided in a blinker lever of the host vehicle, and detects the turn-on state of the blinker from a driver's operation of the blinker lever. The blinker sensor transmits detected blinker information to the ECU 10.

The HMI 3 is an interface that is provided to perform an input and output of information between the collision avoidance device 100 and an occupant. The HMI 3 includes, for example, a display, a speaker, and the like. The HMI 3 performs an image output of the display and a sound output from the speaker according to a control signal from the ECU 10. The display may be a head-up display. The HMI 3 includes, for example, input equipment (buttons, a touch panel, a sound input device, and the like) for reception of an input from the occupant.

The actuator 4 is equipment that is used for control of the host vehicle. The actuator 4 includes at least actuators for controlling a behavior of the vehicle, such as a throttle actuator, a brake actuator, and a steering actuator. The throttle actuator controls the amount (throttle valve opening degree) of air supplied to an engine according to a control signal from the ECU 10, and controls drive power of the host vehicle. In a case where the host vehicle is a hybrid vehicle, in addition to the amount of air supplied to the engine, a control signal from the ECU 10 is input to a motor as a power source and the drive power is controlled. In a case where the host vehicle is an electric vehicle, a control signal from the ECU 10 is input to a motor (a motor that functions as an engine) as a power source and the drive power is controlled. In the above-described cases, the motor as a power source constitutes the actuator 4.

The brake actuator controls a brake system according to a control signal from the ECU 10, and controls braking force that is given to the wheels of the host vehicle. As the brake system, for example, a hydraulic brake system can be used. The steering actuator controls the drive of an assist motor configured to control steering torque in an electric power steering system according to a control signal from the ECU 10. With the above description, the steering actuator controls steering torque of the host vehicle.

A functional configuration of the ECU 10 will be described. The ECU 10 has an obstacle recognition unit 11, a collision possibility determination unit 12, a blinker state recognition unit 13, an intersection angle recognition unit 14, a deflection angle calculation unit 15, and a collision avoidance controller 16.

The obstacle recognition unit 11 recognizes an obstacle around the host vehicle based on a detection result of the external sensor 1. The obstacle recognition unit 11 recognizes a position of an obstacle with respect to the host vehicle. The obstacle recognition unit 11 may recognize a relative moving direction of an obstacle with respect to the host vehicle. The obstacle recognition unit 11 may recognize the type of an obstacle (another vehicle, pedestrian, bicycle, or the like) using known methods.

The collision possibility determination unit 12 determines whether or not there is a collision possibility between the host vehicle and the obstacle based on a path of the host vehicle and the position of the obstacle. The collision possibility determination unit 12 estimates the path (predicted trajectory) of the host vehicle based on a detection result of the internal sensor 2. For example, the collision possibility determination unit 12 estimates the path of the host vehicle based on the yaw rate of the host vehicle detected by the yaw rate sensor and the vehicle speed of the host vehicle detected by the vehicle speed sensor. The collision possibility determination unit 12 may estimate the path as a turning circle of the host vehicle turning right or left from the yaw rate and the vehicle speed in the host vehicle turning right or left. The collision possibility determination unit 12 may estimate the path of the host vehicle using other known methods.

The collision possibility determination unit 12 recognizes a temporal change (for example, a change in the position of the obstacle for the last 300 milliseconds) of the position of the obstacle based on a recognition result of the obstacle recognition unit 11. The collision possibility determination unit 12 performs correction corresponding to the estimation result of the path of the host vehicle on the temporal change of the position of the obstacle based on the estimated path of the host vehicle and the temporal change of the position of the obstacle, thereby performing coordinate conversion to a relative position in a planar coordinate system based on the host vehicle.

Figure 2:
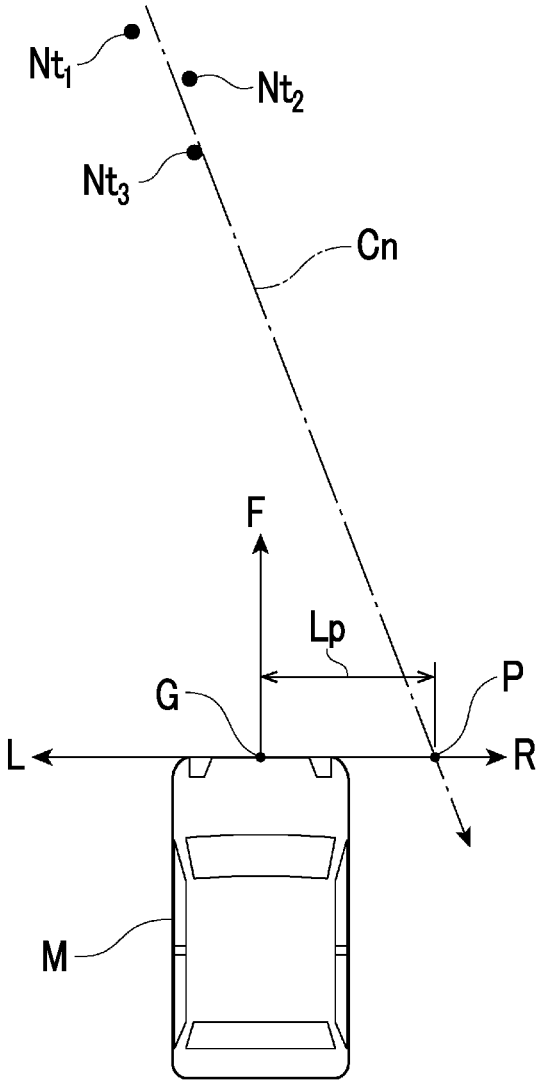
FIG. 2 is a plan view illustrating determination on a collision possibility between a host vehicle and an obstacle.

FIG. 2 is a plan view illustrating determination on a collision possibility between the host vehicle and an obstacle. Determination on a collision possibility between the host vehicle and an obstacle will be described referring to FIG. 2. FIG. 2 shows relative positions $Nt_1$ to $Nt_3$ of an obstacle at times $t_1$ to $t_3$ in a planar coordinate system based on a host vehicle M. In the planar coordinate system based on the host vehicle M, the center of a front end of the host vehicle M is set as a coordinate origin G, a coordinate axis extending in front of the host vehicle M is set as F, a coordinate axis extending in a right direction of the host vehicle M is set as R, and a coordinate axis extending in a left direction of the host vehicle M is set as L. The coordinate axis R and the coordinate axis L are collectively referred to as a lateral coordinate axis LR.

The collision possibility determination unit 12 performs correction of the estimation result of the path of the host vehicle M on an assumption that the vehicle speed of the host vehicle M is maintained, and performs coordinate conversion of the position of the obstacle recognized by the obstacle recognition unit 11 to the planar coordinate system based on the host vehicle M to obtain the relative positions $Nt_1$ to $Nt_3$ of the obstacle. The relative positions $Nt_1$ to $Nt_3$ of the obstacle can be obtained using known methods.

The collision possibility determination unit 12 performs linear approximation based on the relative positions $Nt_1$ to $Nt_3$ of the obstacle using known methods, such as random sample consensus [RANSAC], thereby obtaining a relative path estimation straight line Cn of the obstacle in the planar coordinate system based on the host vehicle M. The collision possibility determination unit 12 obtains an intersection point P of the relative path estimation straight line Cn of the obstacle and the lateral coordinate axis LR of the planar coordinate system.

The collision possibility determination unit 12 determines whether or not there is a collision possibility between the host vehicle M and the obstacle based on the distance Lp between the intersection point P and the coordinate origin G. The collision possibility determination unit 12 determines that there is no collision possibility between the host vehicle M and the obstacle in a case where the distance Lp between the intersection point P and the coordinate origin G is equal to or greater than a distance threshold. The collision possibility determination unit 12 determines that there is a collision possibility between the host vehicle M and the obstacle in a case where the distance Lp between the intersection point P and the coordinate origin G is less than the distance threshold. The distance threshold is a value set in advance. A determination method on a collision possibility between the host vehicle M and the obstacle is not limited to the above-described method.

The blinker state recognition unit 13 recognizes a turn-on state of a blinker of the host vehicle M based on a detection result of the internal sensor 2 (a detection result of the blinker sensor). The blinker state recognition unit 13 recognizes which of a right blinker and a left blinker is turned on or whether no blinker is turned on.

The intersection angle recognition unit 14 recognizes an intersection angle between a first lane on which the host vehicle M is traveling and a second lane that the host vehicle M enters in a case where the blinker state recognition unit 13 recognizes that one of the right and left blinkers of the host vehicle M is in the turn-on state. The intersection angle recognition unit 14 specifies the second lane using known methods.

Figure 3:
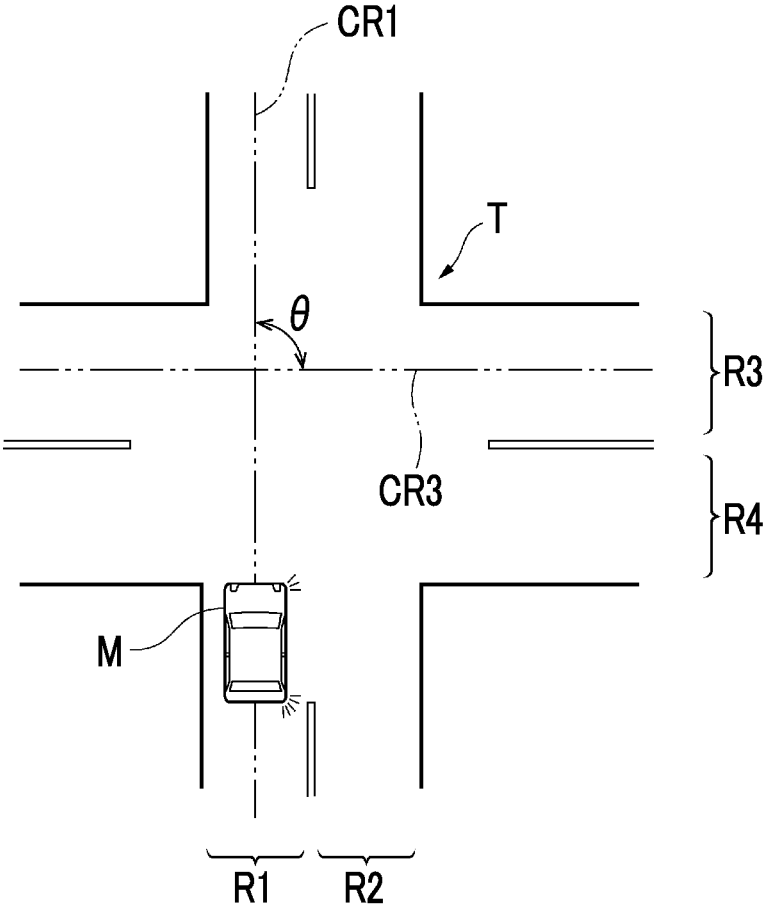
FIG. 3 is a plan view illustrating an intersection angle at an intersection that the host vehicle turning right or left enters.

FIG. 3 is a plan view illustrating an intersection angle at an intersection that the host vehicle M turning right or left enters. FIG. 3 shows an intersection T, a first lane R1 on which the host vehicle M is traveling, a first oncoming lane R2 facing the first lane, a second lane R3 that the host vehicle M turning right enters, and a second oncoming lane R4 facing the second lane. A lane center line CR1 of the first lane R1, a lane center line CR3 of the second lane R3, and an intersection angle θ between the lane center line CR1 and the lane center line CR3 are also shown.

For example, the intersection angle recognition unit 14 recognizes the white lines of the first lane R1 and the second lane R3 based on a detection result (the imaging information of the camera, or the like) of the external sensor 1 to obtain the intersection angle θ. The intersection angle recognition unit 14 may perform self-position estimation of the host vehicle M using known methods and may obtain the intersection angle θ from the self-position and map information. In addition, the intersection angle recognition unit 14 may obtain the intersection angle θ using known methods.

The deflection angle calculation unit 15 calculates a deflection angle of the host vehicle M in a case where the blinker state recognition unit 13 recognizes that one of the right and left blinkers of the host vehicle M is in the turn-on state. The deflection angle is a change angle of a direction of the host vehicle M turning in a direction of a blinker in a turn-on state based on a direction of the host vehicle M when the host vehicle M switches the blinker into the turn-on state.

Figure 4B:
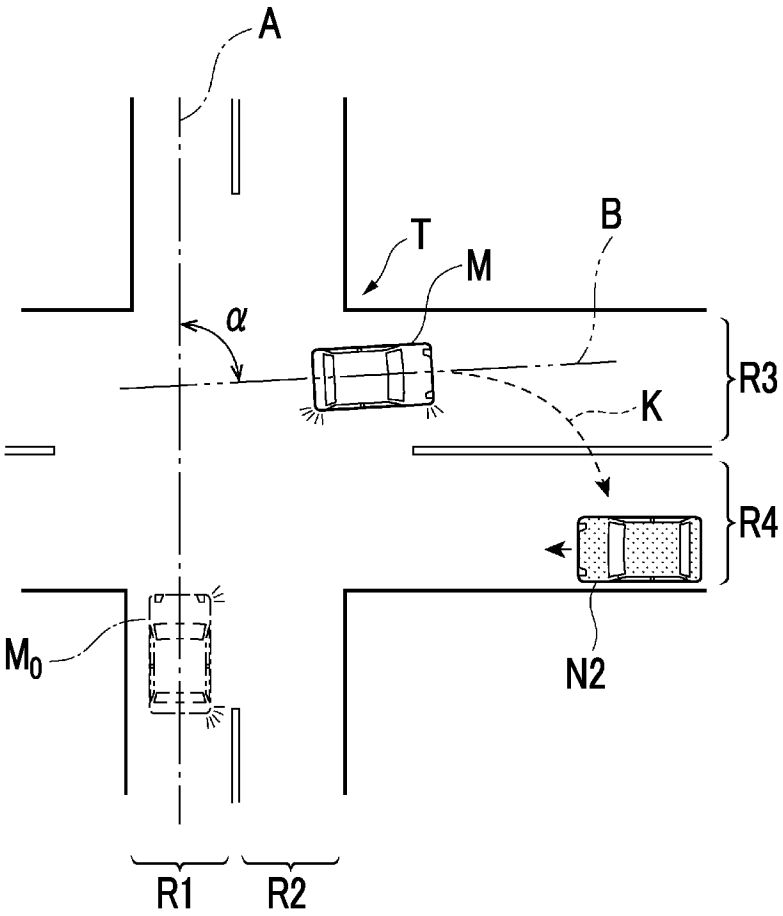
FIG. 4B is a plan view illustrating an example of suppressing unneeded collision avoidance control.
Figure 4A:
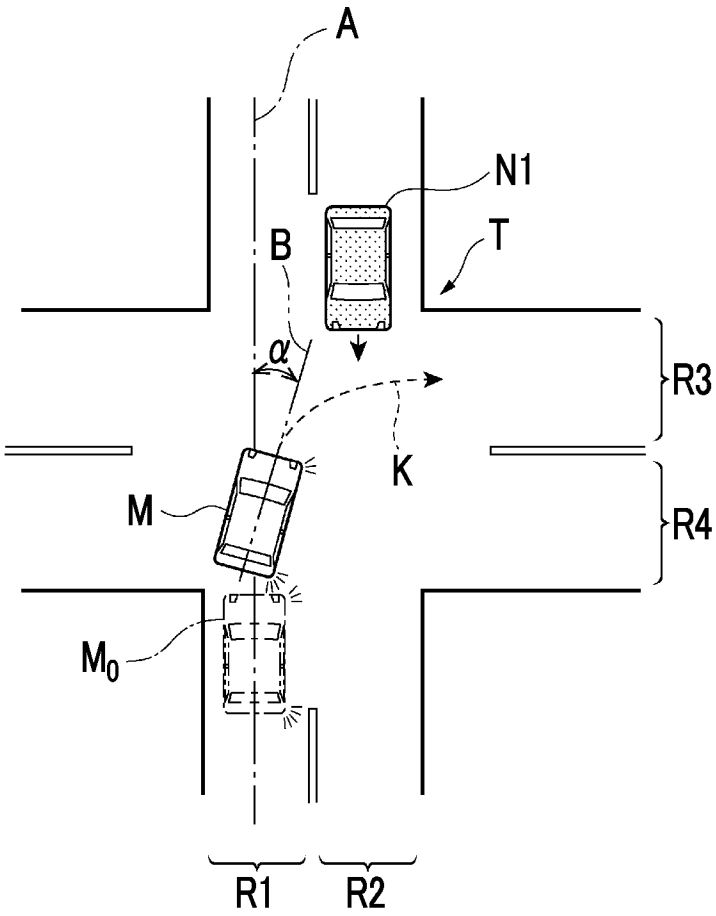
FIG. 4A is a plan view illustrating a deflection angle of the host vehicle.

FIG. 4A is a plan view illustrating the deflection angle of the host vehicle M. FIG. 4A shows a position $M_0$ of the host vehicle M when a blinker is switched into a turn-on state, a reference line A corresponding to a direction of the host vehicle M at the position $M_0$, a longitudinal center line B of the host vehicle M corresponding to a direction of the host vehicle M turning right, a deflection angle α between the reference line A and the longitudinal center line B, a path K of the host vehicle M turning right, and an oncoming vehicle N1 that travels on a first oncoming lane R2. FIG. 4A shows an initial condition (a first half condition of right turn) in which the host vehicle M starts turning right. The reference line A shown in FIG. 4A coincides with the lane center line CR1 of the first lane R1 shown in FIG. 3; however, the reference line A does not necessarily coincide with the lane center line CR1 of the first lane R1.

In the condition shown in FIG. 4A, in a case where the blinker state recognition unit 13 recognizes that one of the right and left blinkers of the host vehicle M is in the turn-on state, the deflection angle calculation unit 15 recognizes the reference line A corresponding to the direction of the host vehicle M when the host vehicle M switches the blinker into the turn-on state. Thereafter, the deflection angle calculation unit 15 recognizes the longitudinal center line B of the host vehicle M corresponding to the direction of the host vehicle M turning right based on a detection result (the yaw rate of the host vehicle M detected by the yaw rate sensor, and the like) of the internal sensor 2. The deflection angle calculation unit 15 obtains the deflection angle α between the reference line A and the longitudinal center line B. A calculation method of the deflection angle is not limited to the above-described method.

In a case where the intersection angle recognition unit 14 recognizes the intersection angle θ, the deflection angle calculation unit 15 sets a deflection angle threshold based on the intersection angle θ. For example, in a case where the intersection angle θ is less than an intersection angle threshold, the deflection angle calculation unit 15 sets the deflection angle threshold to a smaller value than in a case where the intersection angle θ is equal to or greater than the intersection angle threshold. The deflection angle calculation unit 15 may set the deflection angle threshold to a smaller value when the intersection angle θ is smaller.

Even though the intersection angle θ is identical, the deflection angle calculation unit 15 may set, to different values, the deflection angle threshold in a case where the host vehicle M turns right and the deflection angle threshold in a case where the host vehicle M turns left. In a case where the intersection angle θ cannot be recognized, the deflection angle calculation unit 15 may set a value set in advance as the deflection angle threshold.

In a case where the collision possibility determination unit 12 determines that there is a collision possibility between the host vehicle M and the obstacle, the collision avoidance controller 16 executes collision avoidance control for avoiding a collision between the host vehicle M and the obstacle. The collision avoidance control includes at least one of a warning to a driver of the host vehicle M, image display (display on the display) of an alert to the driver of the host vehicle M, braking control of the host vehicle M, and steering control of the host vehicle M. The collision avoidance controller 16 transmits a control signal to the HMI 3 or the actuator 4 to execute the collision avoidance control of the host vehicle M.

In the condition shown in FIG. 4A, in a case where the collision possibility determination unit 12 determines that there is a collision possibility between the host vehicle M and an oncoming vehicle N1, the collision avoidance controller 16 executes the collision avoidance control, such as the braking control of the host vehicle M, for avoiding a collision between the host vehicle M and the oncoming vehicle N1.

The deflection angle calculation unit 15 instructs the collision avoidance controller 16 to execute the collision avoidance control when the deflection angle α is equal to or less than the deflection angle threshold. Even in a case where the collision possibility determination unit 12 determines that there is a collision possibility between the host vehicle M and the obstacle, when the deflection angle α of the host vehicle M calculated by the deflection angle calculation unit 15 is equal to or greater than the deflection angle threshold, the collision avoidance controller 16 does not execute the collision avoidance control (inhibits the collision avoidance control) of the host vehicle M.

FIG. 4B is a plan view illustrating an example of suppressing unneeded collision avoidance control. FIG. 4B shows a condition (a second half condition of right turn) in which the host vehicle M substantially completes a right turn and enters the second lane R3.

In FIG. 4B, while the host vehicle M substantially completes the right turn, turning of the host vehicle M is not ended. Thus, a path K of the host vehicle M estimated based on the yaw rate of the host vehicle M, and the like becomes a curve (turning circle) and is formed into the second oncoming lane R4. For this reason, in the collision avoidance device of the related art, determination is made that there is a collision possibility between the path K of the host vehicle M substantially completing the right turn and an oncoming vehicle N2 traveling on the second oncoming lane R4, and there is a possibility that unneeded collision avoidance control is executed. In the collision avoidance device 100 according to the embodiment, when the host vehicle M sufficiently turns and the deflection angle α becomes equal to or greater than the deflection angle threshold, the collision avoidance control is not executed. Thus, it is possible to suppress execution of unneeded collision avoidance control due to the oncoming vehicle N2 in the condition shown in FIG. 4B.

Figure 5:
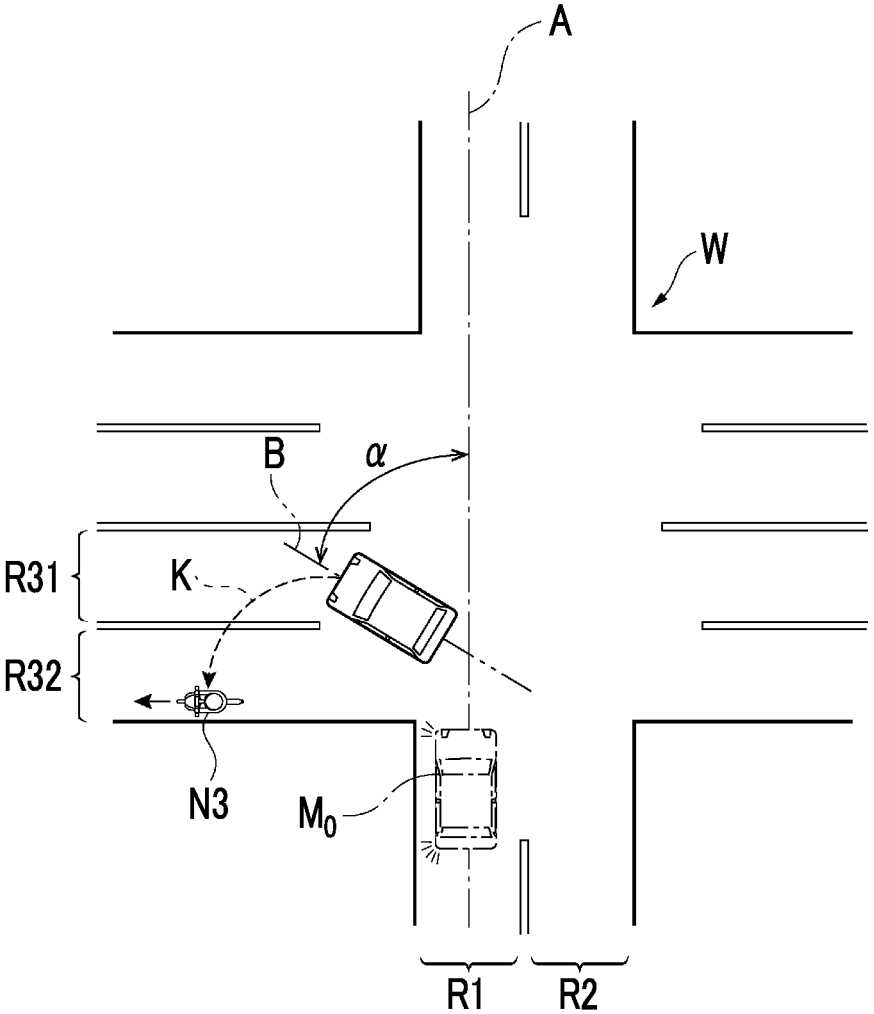
FIG. 5 is a plan view illustrating another example of suppressing unneeded collision avoidance control.

FIG. 5 is a plan view illustrating another example of suppressing unneeded collision avoidance control. FIG. 5 shows a condition in which the host vehicle M turns left to a road having two lanes per side that the current lane intersects at an intersection. FIG. 5 shows an intersection W, a second lane R31 that the host vehicle M turning left enters, an adjacent lane R32 adjacent to the second lane R31, and a bicycle N3 traveling on the adjacent lane R32. The second lane R31 is a lane positioned on a farther side when viewed from the host vehicle M, out of the two lanes per side that the current lane intersects at the intersection W. The adjacent lane R32 is a lane positioned on a nearer side when viewed from the host vehicle M, out of the two lanes per side that the current lane intersects at the intersection W.

Even in the situation shown in FIG. 5, while the host vehicle M substantially completes a left turn, turning of the host vehicle M is not ended. Thus, a path K of the host vehicle M estimated based on the yaw rate of the host vehicle M, and the like becomes a curve (turning circle) and is formed to the adjacent lane R32. For this reason, in the collision avoidance device of the related art, there is a possibility that unneeded collision avoidance control is executed on an obstacle, such as the bicycle N3 traveling on the adjacent lane R32. In the collision avoidance device 100 according to the embodiment, when the host vehicle M turning left sufficiently turns and the deflection angle $\alpha$ becomes equal to or greater than the deflection angle threshold, the collision avoidance control is not executed. Thus, it is possible to suppress unneeded collision avoidance control due to the bicycle N3 in the condition shown in FIG. 5.

A form may be made in which, while the host vehicle M is turning in an opposite direction to a blinker in a turn-on state, the scene is not a scene assumed by the present collision avoidance control (right-turn oncoming vehicle PCS), such as a preliminary operation before a right or left turn or a lane change; thus, the collision avoidance controller 16 does not execute the collision avoidance control (inhibits the collision avoidance control).

Control of Collision Avoidance Device

Control of the collision avoidance device 100 according to the embodiment will be described.

Collision Avoidance Control

Figure 6:
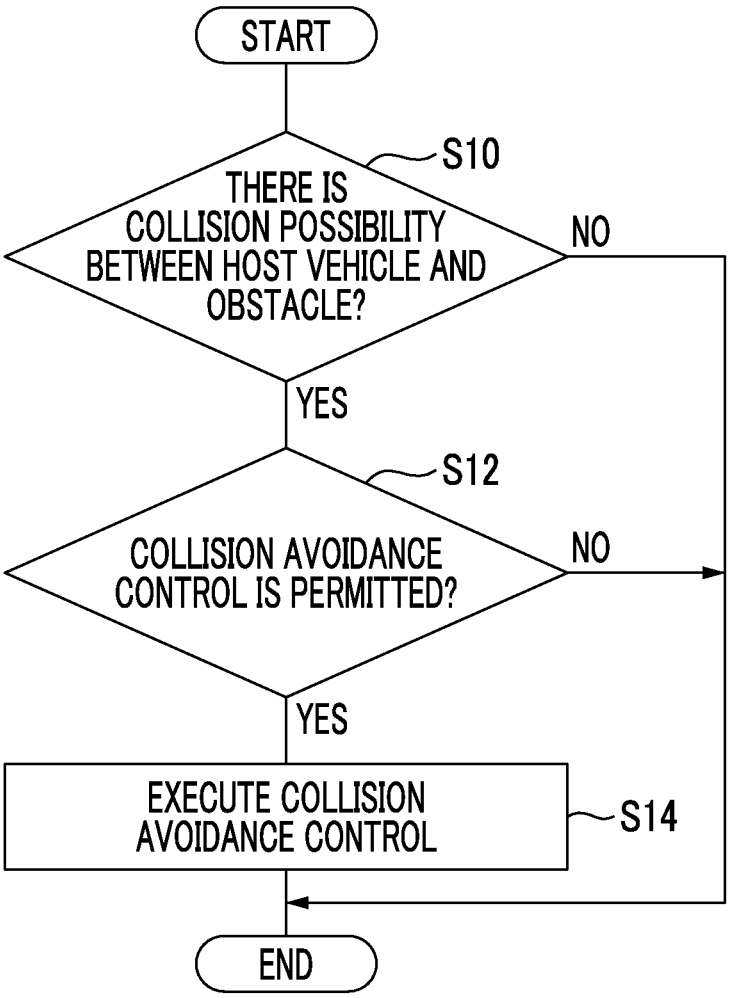
FIG. 6 is a flowchart showing collision avoidance control.

FIG. 6 is a flowchart showing the collision avoidance control. The flowchart shown in FIG. 6 is executed in a case where the host vehicle M detects an obstacle. Processing of the flowchart shown in FIG. 6 is performed as processing for right-turn oncoming vehicle PCS in a case where the vehicle speed of the host vehicle M is equal to or lower than a given value (for example, 20 km/h) when a blinker of the host vehicle M is turned on.

As shown in FIG. 6, the ECU 10 of the collision avoidance device 100 determines whether or not there is a collision possibility between the host vehicle M and an obstacle with the collision possibility determination unit 12 as S10. The collision possibility determination unit 12 determines whether or not there is a collision possibility between the host vehicle M and an obstacle based on the path of the host vehicle M and a position of the obstacle. In a case where determination is made that there is no collision possibility between the host vehicle M and the obstacle (S10: NO), the ECU 10 ends the present processing. Thereafter, the ECU 10 repeats the processing from S10 again after a given time elapses. In a case where determination is made that there is a collision possibility between the host vehicle M and the obstacle (S10: YES), the ECU 10 progresses to S12.

In S12, the ECU 10 determines whether or not the collision avoidance control is permitted. In a case where the collision avoidance control is not inhibited through inhibition processing of the collision avoidance control described below, the ECU 10 determines that the collision avoidance control is permitted. In a case where determination is made that the collision avoidance control is not permitted (S12: NO), the ECU 10 ends the present processing. Thereafter, the ECU 10 repeats the processing from S10 again in a case where a different obstacle is detected. In a case where determination is made that the collision avoidance control is permitted (S12: YES), the ECU 10 progresses to S14.

In S14, the ECU 10 executes the collision avoidance control for avoiding a collision between the host vehicle M and the obstacle with the collision avoidance controller 16. The collision avoidance controller 16 transmits a control signal to the HMI 3 or the actuator 4 to execute the collision avoidance control of the host vehicle M. Thereafter, the ECU 10 ends the present processing.

Calculation Start Processing of Deflection Angle

Figure 7B:
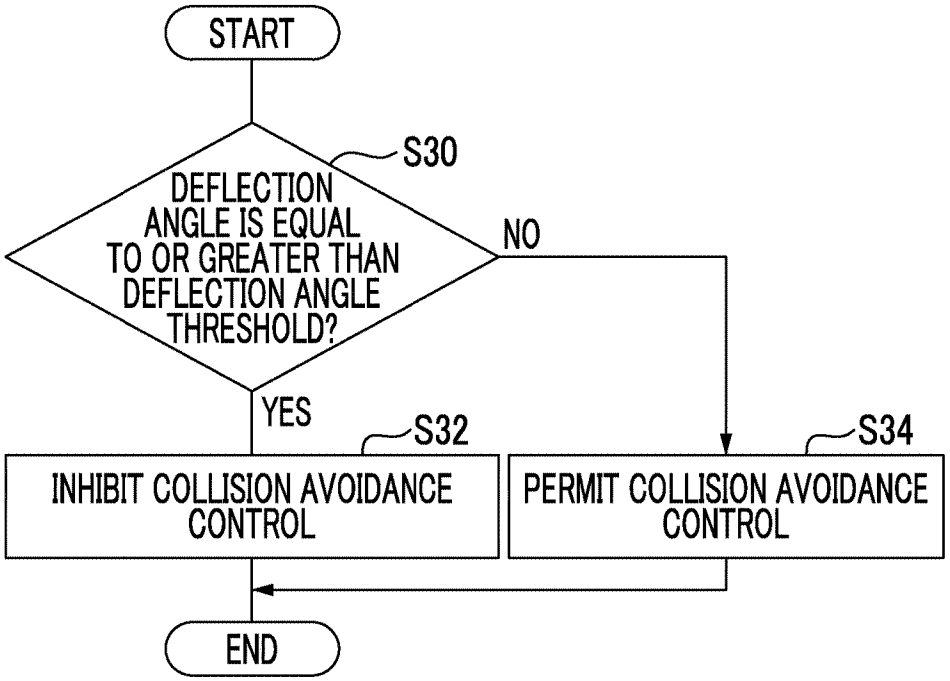
FIG. 7B is a flowchart showing inhibition processing of the collision avoidance control.
Figure 7A:
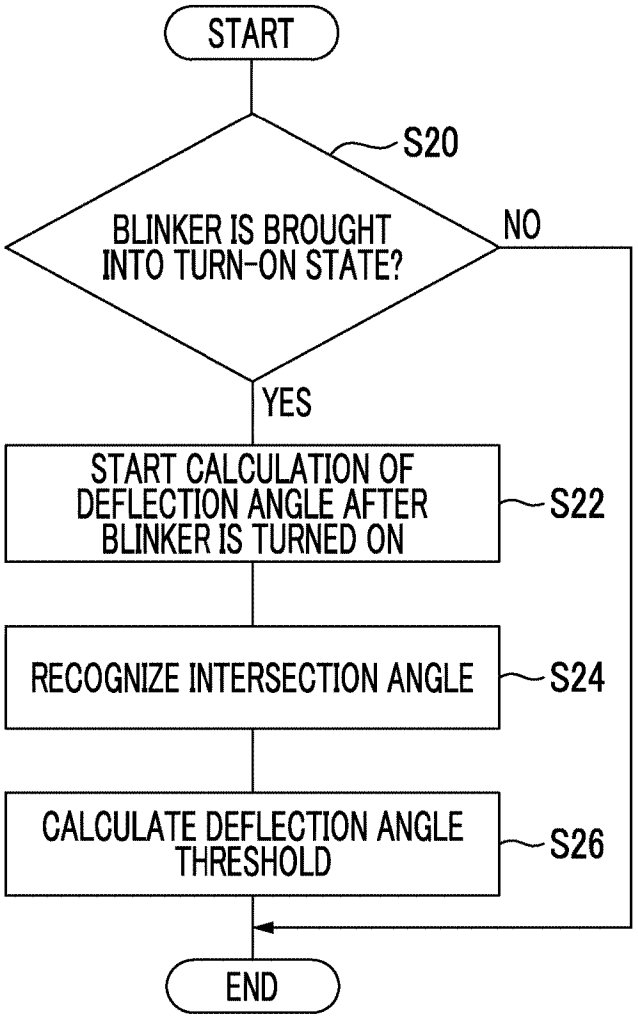
FIG. 7A is a flowchart showing calculation start processing of the deflection angle.

FIG. 7A is a flowchart showing calculation start processing of the deflection angle. Processing of the flowchart shown in FIG. 7A is performed during traveling of the host vehicle M.

As shown in FIG. 7A, the ECU 10 determines whether or not a blinker of the host vehicle M is brought into the turn-on state with the blinker state recognition unit 13 as S20. The blinker state recognition unit 13 recognizes a turn-on state of a blinker of the host vehicle M based on the detection result of the internal sensor 2 (the detection result of the blinker sensor). In a case where determination is not made that the blinker of the host vehicle M is brought into the turn-on state (S20: NO), the ECU 10 ends the present processing. Thereafter, the ECU 10 repeats the processing from S20 again after a given time elapses. In a case where determination is made that the blinker of the host vehicle M is brought into the turn-on state (S20: YES), the ECU 10 progresses to S22.

In S22, the ECU 10 starts calculation of the deflection angle $\alpha$ after turning on of the blinker of the host vehicle M with the deflection angle calculation unit 15. The deflection angle calculation unit 15 calculates the deflection angle $\alpha$, which is a change angle of a direction of the host vehicle M turning in a direction of the blinker in the turn-on state based on a direction of the host vehicle M when the host vehicle M switches the blinker into the turn-on state, according to the detection result (the yaw rate of the host vehicle M detected by the yaw rate sensor, or the like) of the internal sensor 2.

In S24, the ECU 10 recognizes the intersection angle $\theta$ with the intersection angle recognition unit 14. The intersection angle recognition unit 14 recognizes, based on the detection result (the imaging information of the camera, or the like) of the external sensor 1, the intersection angle $\theta$ between a first lane on which the host vehicle M is traveling and a second lane that the host vehicle M enters.

In S26, the ECU 10 calculates the deflection angle threshold with the deflection angle calculation unit 15. The deflection angle calculation unit 15 sets the deflection angle threshold based on the intersection angle $\theta$. In a case where the intersection angle $\theta$ is less than the intersection angle threshold, the deflection angle calculation unit 15 sets the deflection angle threshold to a smaller value than in a case where the intersection angle $\theta$ is less than the intersection angle threshold. Thereafter, the ECU 10 ends the present processing. In a case where all blinkers of the host vehicle M during traveling are brought into a turn-off state, the ECU 10 repeats the processing from S20 again.

The ECU 10 may perform the processing S24 earlier than S22 or may perform the processing of S24 and S26 earlier than S22. The ECU 10 may perform S22 and S24 simultaneously. When the intersection angle $\theta$ cannot be recognized, S24 and S26 may not be performed. In this case, a value set in advance may be used as the deflection angle threshold.

Inhibition Processing of Collision Avoidance Control

FIG. 7B is a flowchart showing inhibition processing of the collision avoidance control. Processing of the flowchart shown in FIG. 7B is performed in a case where the processing of S22 of FIG. 7A is performed.

As shown in FIG. 7B, the ECU 10 determines whether or not the deflection angle α of the host vehicle M is equal to or greater than the deflection angle threshold with the collision avoidance controller 16 as S30. In a case where determination is made that the deflection angle α of the host vehicle M is equal to or greater than the deflection angle threshold (S30: YES), the ECU 10 progresses to S32. In a case where determination is made that the deflection angle α of the host vehicle M is not equal to or greater than the deflection angle threshold (S30: NO), the ECU 10 progresses to S34.

In S32, the ECU 10 inhibits the collision avoidance control with the collision avoidance controller 16. Thereafter, the ECU 10 ends the present processing. In addition, the processing of the flowchart shown in FIG. 7B ends in a case where a blinker is switched into a turn-off state.

In S34, the ECU 10 permits the collision avoidance control with the collision avoidance controller 16. Thereafter, the ECU 10 ends the present processing and repeats the processing from S30 again after a given time elapses. In the meantime, the deflection angle calculation unit 15 repeats the calculation of the deflection angle α of the host vehicle M turning right or left. The ECU 10 may omit the processing of S34.

Functional Effects of Collision Avoidance Device

With the collision avoidance device 100 according to the embodiment described above, even in a case where determination is made that there is a collision possibility between the host vehicle M and the obstacle from the path of the host vehicle M turning right or left and the position of the obstacle, when the deflection angle α of the host vehicle M based on the direction of the host vehicle M when the host vehicle M turning right or left switches the blinker into the turn-on state is equal to or greater than the deflection angle threshold, the collision avoidance control is not performed. Accordingly, with the collision avoidance device 100, the time when the deflection angle α of the host vehicle M is equal to or greater than the deflection angle threshold is immediately before a right or left turn of the host vehicle M is completed, and there is a high possibility that determination is erroneously made on a collision possibility between the obstacle on the oncoming lane of the road to be a right or left turn destination and the host vehicle M. For this reason, it is possible to suppress execution of unneeded collision avoidance control by not executing the collision avoidance control.

With the collision avoidance device 100, the turning angle (deflection angle) needed for completion of a right or left turn of the host vehicle M changes with the intersection angle θ between the first lane on which the host vehicle M is traveling and the second lane that the host vehicle M enters. For this reason, the deflection angle threshold changes based on the intersection angle θ, whereby it is possible to appropriately suppress the execution of the collision avoidance control.

Although a preferred embodiment of the disclosure has been described as above, the disclosure is not limited to the above-described embodiment. The disclosure may be subjected to various modifications and improvements based on common knowledge of those skilled in the art including the embodiment described above.

For example, in the embodiment, although an example in a left-hand traffic country or zone has been described, the disclosure can be appropriately carried out in a right-hand traffic country or zone. The collision avoidance device 100 may perform determination on a collision possibility and the execution of the collision avoidance control as the right-turn oncoming vehicle PCS described above solely when the host vehicle M turns right (the right blinker is turned on) in a left-hand traffic country or zone. Similarly, the collision avoidance device 100 may perform determination on a collision possibility and the execution of the collision avoidance control solely when the host vehicle M turns left (the left blinker is turned on) in a right-hand traffic country or zone.

The collision possibility determination unit 12 may estimate a path of an obstacle on a map from the position of the obstacle. The collision possibility determination unit 12 may determine that there is a collision possibility in a case where the path of the host vehicle M and the path of the obstacle intersect each other and the distance between the host vehicle M and the obstacle is equal to or less than a threshold.

The collision avoidance device 100 does not need to have the intersection angle recognition unit 14. In this case, the deflection angle calculation unit 15 may set the deflection angle threshold from the position of the host vehicle M on the map using table data with an intersection on the map associated with the deflection angle threshold. The deflection angle calculation unit 15 may change the deflection angle threshold based on the vehicle speed of the host vehicle M. In a case where the vehicle speed of the host vehicle M is equal to or higher than a vehicle speed threshold, the deflection angle calculation unit 15 may set the deflection angle threshold to a smaller value than in a case where the vehicle speed of the host vehicle M is lower than the vehicle speed threshold. The deflection angle calculation unit 15 may set the deflection angle threshold to a smaller value when the vehicle speed of the host vehicle M is higher. The deflection angle calculation unit 15 does not need to set the deflection angle threshold, and may set the deflection angle threshold to a fixed value.

The deflection angle calculation unit 15 may calculate the deflection angle α using values other than the yaw rate of the host vehicle M. The deflection angle calculation unit 15 may calculate the deflection angle α based on the lateral acceleration and the vehicle speed of the host vehicle M in the detection result of the internal sensor 2. The yaw rate is obtained from calculation of the lateral acceleration and the vehicle speed of the host vehicle M. The deflection angle calculation unit 15 may calculate the deflection angle α based on an angle (steering angle) of a steering wheel and the vehicle speed of the host vehicle M. Since the lateral acceleration is obtained from the steering angle and the vehicle speed, the yaw rate is obtained from the vehicle speed and the lateral acceleration. The deflection angle calculation unit 15 may calculate the deflection angle α based on a detection result of a global positioning system [GPS] or a detection result of an azimuth magnet. The deflection angle calculation unit 15 may calculate the deflection angle α by obtaining the yaw rate from a circular movement using a tread radius of a tire of the host vehicle M based on an odometry using right and left wheel speeds and the specifications of the vehicle. The deflection angle calculation unit 15 may calculate the deflection angle α from a landmark (a traffic signal, a telegraph pole, or the like) having clear coordinates on a map and a relative positional change (angular change) of the host vehicle M through scan matching using the detection result of the external sensor 1 and map information. The value of the deflection angle α is reset in a case where the blinker is switched from the turn-on state to the turn-off state.

In a case where the collision possibility determination unit 12 determines that there is a collision possibility between the host vehicle M and the obstacle, when the collision avoidance control is not inhibited, the collision avoidance device 100 does not need to execute the collision avoidance control. In a case where the collision possibility determination unit 12 determines that there is a collision possibility between the host vehicle M and the obstacle, even when the collision avoidance control is not inhibited, the collision avoidance device 100 may determine the need for the execution of the collision avoidance control in consideration of various other conditions.

A form may be made in which the collision avoidance device 100 does not perform determination on a collision possibility when the deflection angle α of the host vehicle M is equal to or greater than the deflection angle threshold. That is, when the collision avoidance controller 16 determines that the deflection angle α of the host vehicle M is equal to or greater than the deflection angle threshold, the collision possibility determination unit 12 does not perform determination on whether or not there is a collision possibility between the host vehicle M and the obstacle. In the above-described aspect, the collision possibility determination unit 12 may determine whether or not the deflection angle α of the host vehicle M is equal to or greater than the deflection angle threshold.

Specifically, in the flowchart showing the inhibition processing of the collision avoidance control of FIG. 7B, in a case where the collision avoidance control is not permitted in S32, the processing of the flowchart showing the collision avoidance control of FIG. 6 may not be performed. With the above description, when the deflection angle α of the host vehicle M is equal to or greater than the deflection angle threshold, determination on a collision possibility between the host vehicle M and the obstacle is not performed; thus, the collision avoidance device 100 does not perform the collision avoidance control. Accordingly, the collision avoidance device 100 does not perform the collision avoidance control when the deflection angle α of the host vehicle M is equal to or greater than the deflection angle threshold, whereby it is possible to suppress execution of unneeded collision avoidance control.

What is claimed is:

1. A collision avoidance device comprising an electronic control unit configured to:

calculate a deflection angle that is a change angle of a direction of a host vehicle turning in a direction of a blinker in a turn-on state based on a direction of the host vehicle when the host vehicle switches the blinker into the turn-on state; and execute a collision avoidance control for avoiding a collision between the host vehicle and an obstacle in a case where the electronic control unit determines that there is a collision possibility between the host vehicle and the obstacle based on a path of the host vehicle on an intersection and a position of the obstacle, wherein the electronic control unit is configured not to execute the collision avoidance control when the deflection angle is determined to be equal to or greater than a deflection angle threshold.

2. The collision avoidance device according to claim 1, wherein the electronic control unit is configured to:

recognize an intersection angle between a first lane on which the host vehicle is traveling and a second lane that the host vehicle enters; and set the deflection angle threshold based on the intersection angle.

3. A collision avoidance device comprising electronic control unit configured to:

calculate a deflection angle that is a change angle of a direction of a host vehicle turning in a direction of a blinker in a turn-on state based on a direction of the host vehicle at a time when the host vehicle switches the blinker into the turn-on state; and output a signal for executing a collision avoidance control when the deflection angle is determined to be equal to or less than a deflection angle threshold and the electronic control unit determines that there is a collision possibility between a host vehicle and an obstacle based on a path of the host vehicle on an intersection and a position of the obstacle.

4. The collision avoidance device according to claim 3, wherein the electronic control unit is configured to:

recognize an intersection angle between a first lane on which the host vehicle travels and a second lane that intersects the first lane to form an intersection and that the host vehicle enters; and set the deflection angle threshold based on the intersection angle.

5. The collision avoidance device according to claim 3, further comprising an actuator configured to control a behavior of the vehicle, wherein the actuator is configured to be driven based on a signal from the electronic control unit.

6. The collision avoidance device according to claim 3, wherein the electronic control unit is configured to set the deflection angle threshold based on whether an intersection angle, between a first lane on which the host vehicle travels and a second lane that intersects the first lane to form an intersection and that the host vehicle enters, is recognizable by the electronic control unit.

7. The collision avoidance device according to claim 3, wherein the electronic control unit is configured to set the deflection angle threshold based on a turn direction of the host vehicle.

8. The collision avoidance device according to claim 3, wherein the electronic control unit is configured to set the deflection angle threshold based on a speed of the host vehicle.

* * * * *